US005722817A

United States Patent [19]

Park et al.

[11] Patent Number: 5,722,817

[45] Date of Patent: Mar. 3, 1998

[54] NOISE-REDUCING APPARATUS FOR LINEAR COMPRESSOR

[75] Inventors: Jung Sik Park; Hyung Kook Lee, both of Kyungki-do, Rep. of Korea

[73] Assignee: LG Electronics Inc., Rep. of Korea

[21] Appl. No.: 696,490

[22] Filed: Aug. 14, 1996

[30] Foreign Application Priority Data

Aug. 21, 1995 [KR] Rep. of Korea ..... 25666/1995

[51] Int. Cl.[6] ..... F04B 11/00

[52] U.S. Cl. ..... 417/312; 417/541; 417/550; 181/403

[58] Field of Search ..... 417/312, 902, 417/541, 550, 555.1; 181/229, 403

[56] References Cited

U.S. PATENT DOCUMENTS 2,296,883 9/1942 Trask ..... 417/550

2,622,792 12/1952 Ramclow ..... 417/550

4,532,685 8/1985 Itoh et al. ..... 417/550

4,955,796 9/1990 Terwilliger ..... 417/550

*Primary Examiner*—Charles G. Freay

*Attorney, Agent, or Firm*—Ostrolenk, Faber, Gerb & Soffen, LLP

[57] ABSTRACT

A noise-reducing apparatus for a linear compressor which can significantly reduce noise by forming a multistage silencer in the suction side of a refrigerant passage of a linear compressor in which an axial flow valve system is adopted and therein a plurality of silencers formed connected to the suction side of the refrigerant passage inside a piston slidably disposed inside the cylinder.

11 Claims, 5 Drawing Sheets

NOISE-REDUCING APPARATUS FOR LINEAR COMPRESSOR

BACKGROUND OF THE INVENTION

1. Field of the Invention

The present invention relates to a noise-reducing apparatus for a linear compressor, and in particular, to an improved noise-reducing apparatus for a linear compressor which is capable of significantly reducing noise by forming a multi-stage silencer in the suction side of a refrigerant passage of a linear compressor in which an axial flow valve system is adopted.

2. Description of the Prior Art

Recently, in order to solve many defects of a compressor to which a crank shaft is adopted, by reciprocably moving a piston using a magnet and a coil instead of a crankshaft, the number of components and the manufacturing cost can be reduced, resulting in an improvement in productivity. Simultaneously, motor efficiency is enhanced up to more than 90%, and the electrical consumption can be diminished. In a typical linear compressor according to the conventional art, as shown in FIG. 1, a cylinder 2 is provided having a predetermined distance from an inner bottom surface of an enclosed container 1.

Inside the cylinder, coil assemblies 3,3' are formed to be integral with the cylinder 2.

At a portion of the cylinder 2, a piston spring 4 is fixed, and a piston 5 is connected to an inner central portion of the piston spring 4, which connection enables the piston 5 to make a straight reciprocable movement within the cylinder 2.

A magnet 6 is affixed to an outer circumferential surface of the piston 5, and a plurality of mounting springs 7 are connected between the piston spring 4 and the enclosed container 1, to resiliently support the piston spring 4.

A valve assembly 8 is affixed on a central portion of one end of the cylinder 2, and a suction muffler 9 and a discharging muffler 10 are affixed to respective sides of the valve assembly 8.

Here, the valve assembly 8, as shown in FIG. 2, includes a suction gasket 11, a discharging gasket 15, a suction valve 12, a discharging valve 14 and a valve seat 13, all of which are closely affixed to one another. The shape of each of the above-described elements will now be described in more detail.

First, at a central portion of the suction gasket 11, a central hole 11*a* is formed, and at a central portion of the suction valve 12, a suction opening-closing portion 12*a* having a predetermined shape is pivotally defined, and at one side of the suction opening-closing portion 12*a*, a discharging hole 12*b* is formed.

At a central portion of the valve seat, a suction hole 13*a* is formed, and a discharging hole 13*b* is formed at one side of the suction hole 13*a*.

And, at an inner sider of the discharging valve 14 having a predetermined pierced edge portion, a discharging opening-closing portion 14*b* is flexibly provided for opening and closing the discharging hole 13*b* of the valve seat 13, and at a central portion of the discharging valve 14, a suction hole 14*a* is formed.

In addition, another suction hole 15*a* is formed at a central portion of the discharging gasket 15 having a predetermined pierced edge portion.

Referfence numeral 16 denotes a head cover.

In the above-described linear compressor according to the conventional art, the coil assembly 3,3' affixed to the cylinder 2 and the magnet 6 affixed to the piston 5 carry out a function of a linear motor.

That is, when the piston 5 is moved in the direction of an arrow A inside the cylinder 2 by an electromagnetic force and a resilient energy generated by the linear motor, as shown in FIG. 1, a refrigerant gas flows in through the suction holes 14*a*,15*a* of the discharing gasket 15 and the discharging valve 14 after passing through the suction muffler 9.

Therefore, the discharging opening-closing portion 14*b* of the discharging valve 14 shuts the discharging hole 13*b* of the valve seat due to the in-flowing of the refrigerant and the refrigerant flows in to the suction hole 13*a* of the valve seat 13.

Then, the refrigerant gas pushes the suction opening-closing portion of the suction valve 12 in the rightward direction of FIG. 2, and thereby the gas is drawn in to a compression chamber (C) of the cylinder 2 passing through the central hole 11*a* of the suction gasket 11.

However, when the piston 5 is moved in the direction of arrow B, as shown in FIG. 1, the refrigerant gas is compressed in the compression chamber (C).

Therefore, the refrigerant gas compressed in the compression chamber (C) pushes the suction opening-closing portion 12*a* of the suction valve 12 in the leftward direction in FIG. 2, resulting in shutting of the suction hole 13*a* of the valve seat 13.

Then, passing through the discharging holes 12*b*,13*b* of the suction valve 12 and the valve seat 13, the refrigerant gas pushes the discharging opening-closing portion 14*b* of the discharging valve 14 in the leftward direction in FIG. 2, passes through the discharging gasket 15, and is discharged to the outside through the head cover 16 and the discharging muffler 10.

In accordance with the linear reciprocal movement of the piston 5, the suction, compression and discharging operation of the refrigerant gas are repeatedly performed.

Here, the suction muffler 9 and the discharging muffler 10 respectively provided on the suction side and the discharging side of the refrigerant passage reduce noise.

In the conventional linear compressor, the opening-closing portion of the valve controlling the flow of the refrigerant is a basic factor in improving the efficiency of the compressor. Therefore, in order to enhance the efficiency of the compressor, there is known an axial flow valve system which has the same flow direction of the refrigerant as the movement direction of the piston.

As an example of the axial flow valve system, an inertia valve apparatus which is adopted in the reciprocal movement compressor will now be introduced.

As shown in FIG. 3, a cylindrical groove 21*a* is formed at an inner circumferential surface of a cylinder 21, and a refrigerant suction hole 21*b* leading to the outside is formed at the cylinder groove 21*a*.

In the outer circumferential surface of a piston 22 provided inside the cylinder, a piston groove 22*a* communicating with the cylindrical groove 21*a* is formed.

In addition, at a front central portion of the piston 22, a suction valve 23 is fixed with a caulking by a piston pin 24.

A head cover 25 the inside of which is connected to the cylinder is provided at one side of the cylinder 21, a discharging valve and a spring 27 are inserted inside the head cover 25. Therefore, when the force of the refrigerant gas compressed in the compression chamber (C) of the cylinder 21 exceeds the resilence of the spring 27, and pushes the discharging valve 26 open, the refrigerant is then discharged through a refrigerant discharging pipe 25*a* of the head cover 25.

In the above-described linear compressor in which the axial flow valve system is adopted, the refrigerant is sucked through the refrigerant suction hole 21*b* and the piston groove 22*a* of the cylinder 21. When the piston is moved away from the discharging valve 26 to perform the suction operation, the suction valve is opened and then the refrigerant flows through the gap between the suction valve 23 and the piston, and is sucked into the compression chamber (C).

Then, when the compression of the refrigerant is performed, the refrigerant in the compression chamber (C) is compressed and the pressure on the discharging valve 26 exceeds the force of the spring 27 and the valve 26 is moved away from the piston 22, resulting in the discharging of the refrigerant through the refrigerant discharging pipe 25*a* of the head cover 25.

Then, the piston 22 is moved away from the discharging valve 26 causing the suction valve 23 to separate from the front portion of the piston 22, resulting in the above-described suction operation. Here, the discharging valve 26 is returned to its initial condition by the restoring force of the spring 27.

In the above-described conventional linear compressor in which the axial flow valve system is not adopted, since the suction muffler 9 is provided at the entrance of the refrigerant passage adjoined to the valve assembly 8, the noise generated at the entrance of the refrigerant passage can be effectively reduced, but in the linear compressor in which the axial flow valve system is adopted and which can perform the opening and closing operation of the valve, since the suction side of the refrigerant passage is opened, although the reduction of the sucked noise is most necessary, the suction muffler and the discharging muffler cannot be disposed as they can in the linear compressor in which the axial flow valve system is not adopted because the flowing direction of the refrigerant is the same as the movement direction of the piston, and much noise is generated because a separate noise reducing apparatus is not provided.

SUMMARY OF THE INVENTION

Accordingly, it is an object of the present invention to provide an improved noise-reducing apparatus for a linear compressor which is capable of remarkably reducing the noise by providing a multistage silencer at the suction side of the refrigerant passage.

To achieve the above object, there is provided a noise-reducing apparatus for a linear compressor in which a plurality of silencers connected to the suction side of the refrigerant passage are provided inside a piston which is slidably disposed inside the cylinder for the purpose of reducing noise.

To achieve the above object, there is also provided a noise-reducing apparatus for a linear compressor in which a silencer is provided outside a cylinder for the purpose of reducing noise.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Referring to the accompanying drawings, a noise-reducing apparatus for a linear compressor according to the present invention will now be described in detail.

First, a noise-reducing apparatus for a linear compressor according to an embodiment of the present invention will now be described in detail.

Figure 1:
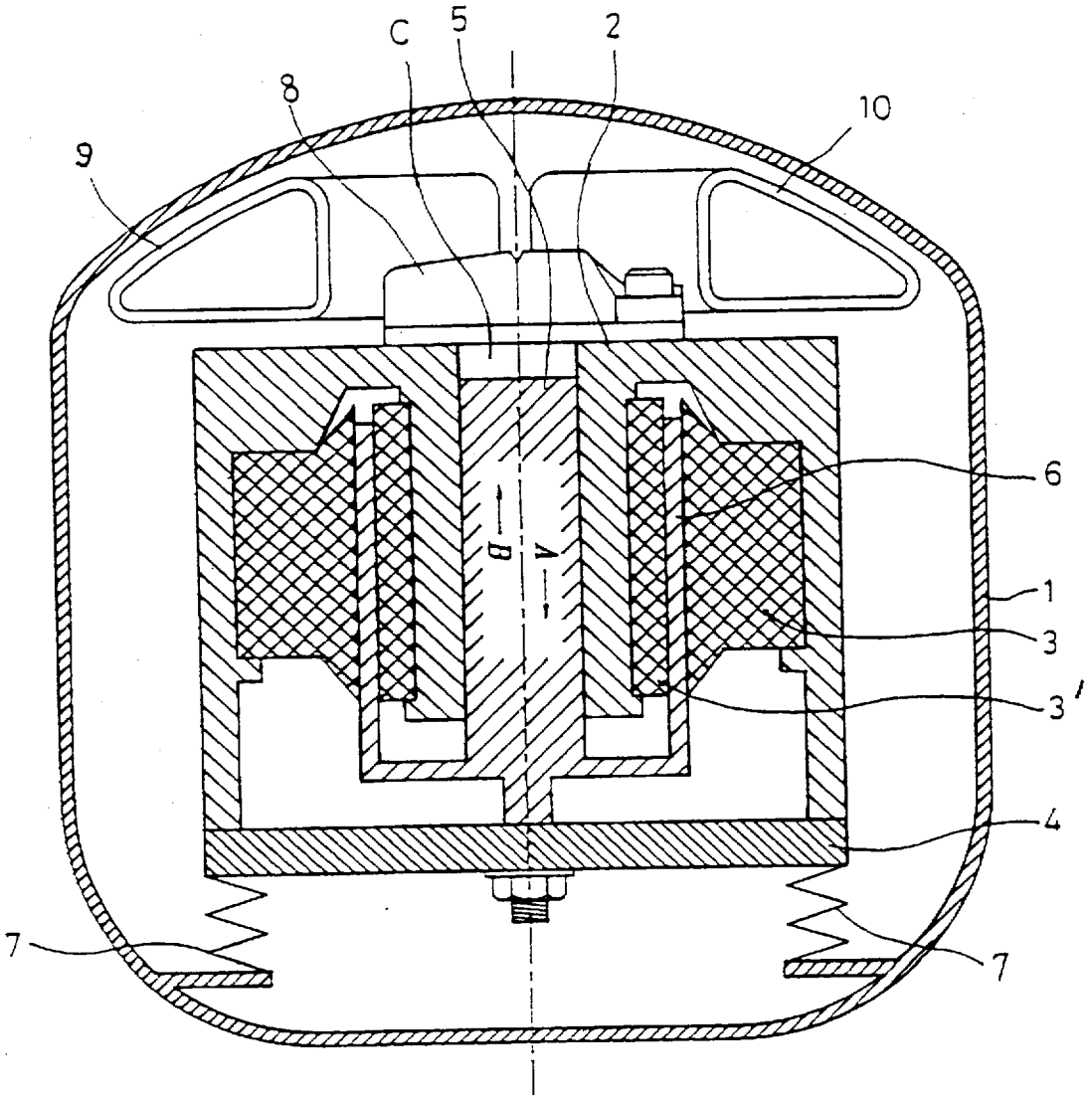
FIG. 1 CONVENTIONAL ART
FIG. 1 is a cross-sectional view of a linear compressor according to the conventional art.
Figure 2:
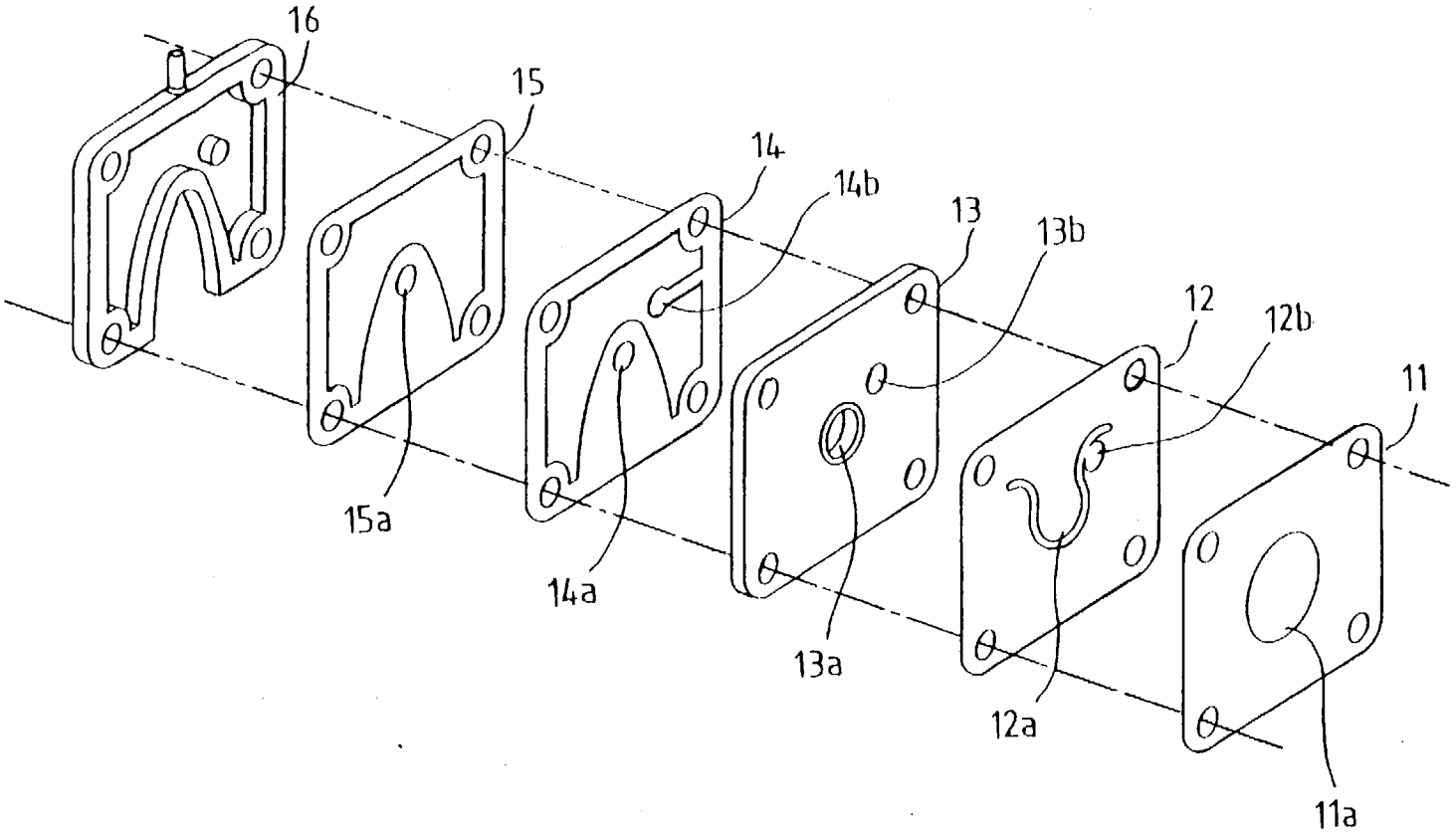
FIG. 2 CONVENTIONAL ART
FIG. 2 is a perspective view of a valve assembly adopted in a linear compressor according to the conventional art.
Figure 3:
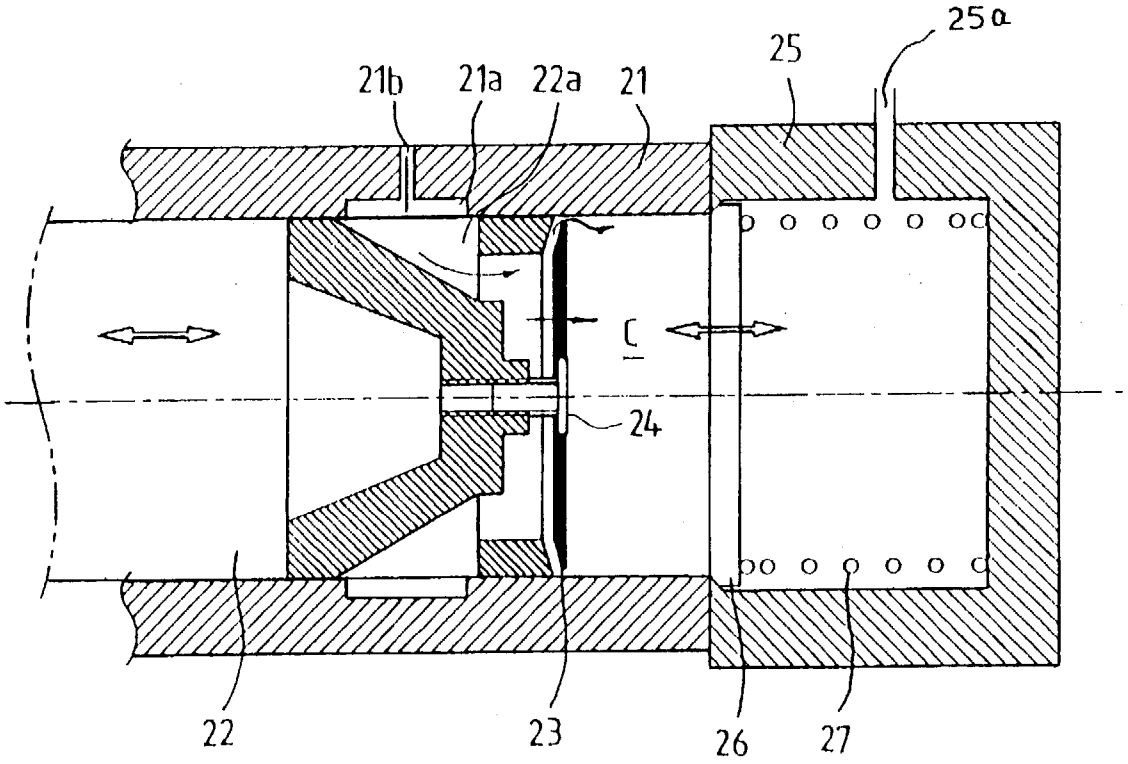
FIG. 3 CONVENTIONAL ART
FIG. 3 is a cross-sectional view of an axial flow valve system adopted in the conventional reciprocal movement compressor.
Figure 4:
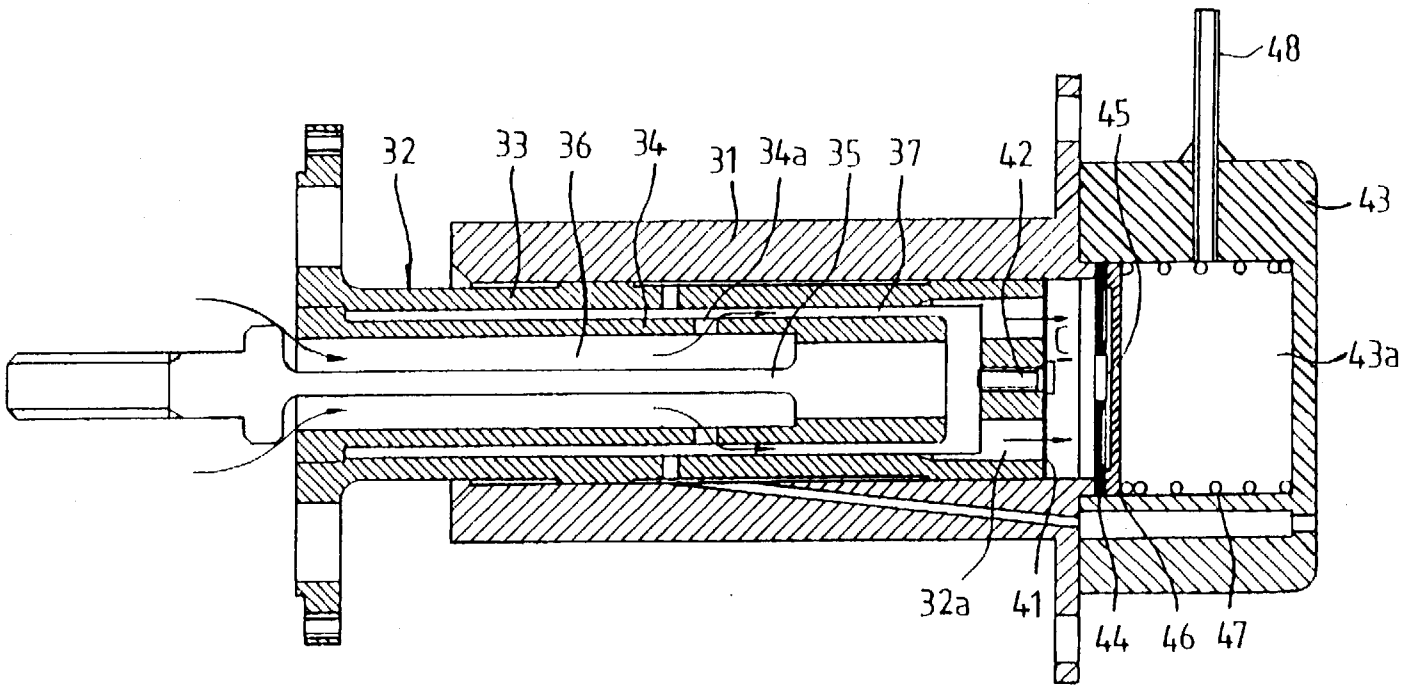
FIG. 4 is a cross-sectional view of a linear compressor in which a noise-reducing apparatus is provided according to an embodiment of the present invention.

As shown in FIG. 4, a piston 32 which is slidable inside of a cylinder 31 employed in the linear compressor according to an embodiment of the present invention is separatedly connected with an exterior piston 33 connected to the cylinder, a rod post 34 connected inside the piston 33 and a piston rod 35 connected to the inside of the road post 34.

Here, a first silencer 36 connected to the entrance of a refrigerant passage is formed between the piston rod 35 and the rod post 34, and a second silencer 37 connected to the first silencer 36 is formed between the rod post 34 and the exterior piston 33.

At a portion of the rod post 34, a passage 34*a* is formed through which the first silencer 36 and the second silencer 37 are mutually communicated.

At the front side of the piston 32, piston holes 32*a* are formed, and to a front central surface of the piston 32, a suction valve 41 is affixed by a piston pin 42.

In an inner receiving groove 43*a* of a head cover 43 affixed to one side of the cylinder 31 are provided a first discharging valve 44, a second discharging valve 45 (according to the two embodiments of the present invention, there are two discharging valves separatedly provided, but the operation and effect of the present invention is not influenced by the number of discharging valves), a stopper 46 and a spring 47.

Referrence numeral 48 in the drawing denotes a refrigerant discharging pipe.

The operation and effect of the noise-reducing apparatus according to the first embodiment will now be described in detail.

When the refrigerant is sucked along the refrigerant passage in the direction of the arrows as shown in FIG. 4 from the rear of the cylinder 31 and flows into the cylinder 31, since the refrigerant flows through the first silencer 36 formed inside the cylinder 31 between the piston rod 35 and the rod post 34, noise of the refrigerant is reduced first when passing through the first silencer 36.

Then, as the refrigerant passes through the passage 34*a* and then the second silencer 37 formed between the rod post 34 and the exterior piston 33, noise of the refrigerant is reduced again.

The refrigerant which flows into the compression chamber (C) of the cylinder after successively passing through the piston hole 32*a* of the piston 32 and the suction valve 24 successively is compressed in the compression chamber (C) when the piston 32 is moved towards the first discharging valve 44 for the performance of compressing operation, and then is discharged to the outside through the refrigerant discharging pipe 48 of the head cover after passing through the first discharging valve 44 and the second discharging valve 45.

Here, the stopper 46 prevents the excessive movement of the second discharging valve 45.

Detailed description of the axial flow valve apparatus including the suction valve 41, the first discharging valve 44, the second discharging valve 45 and the stopper 46 will be omitted, as these operate in the conventional manner.

Figure 5:
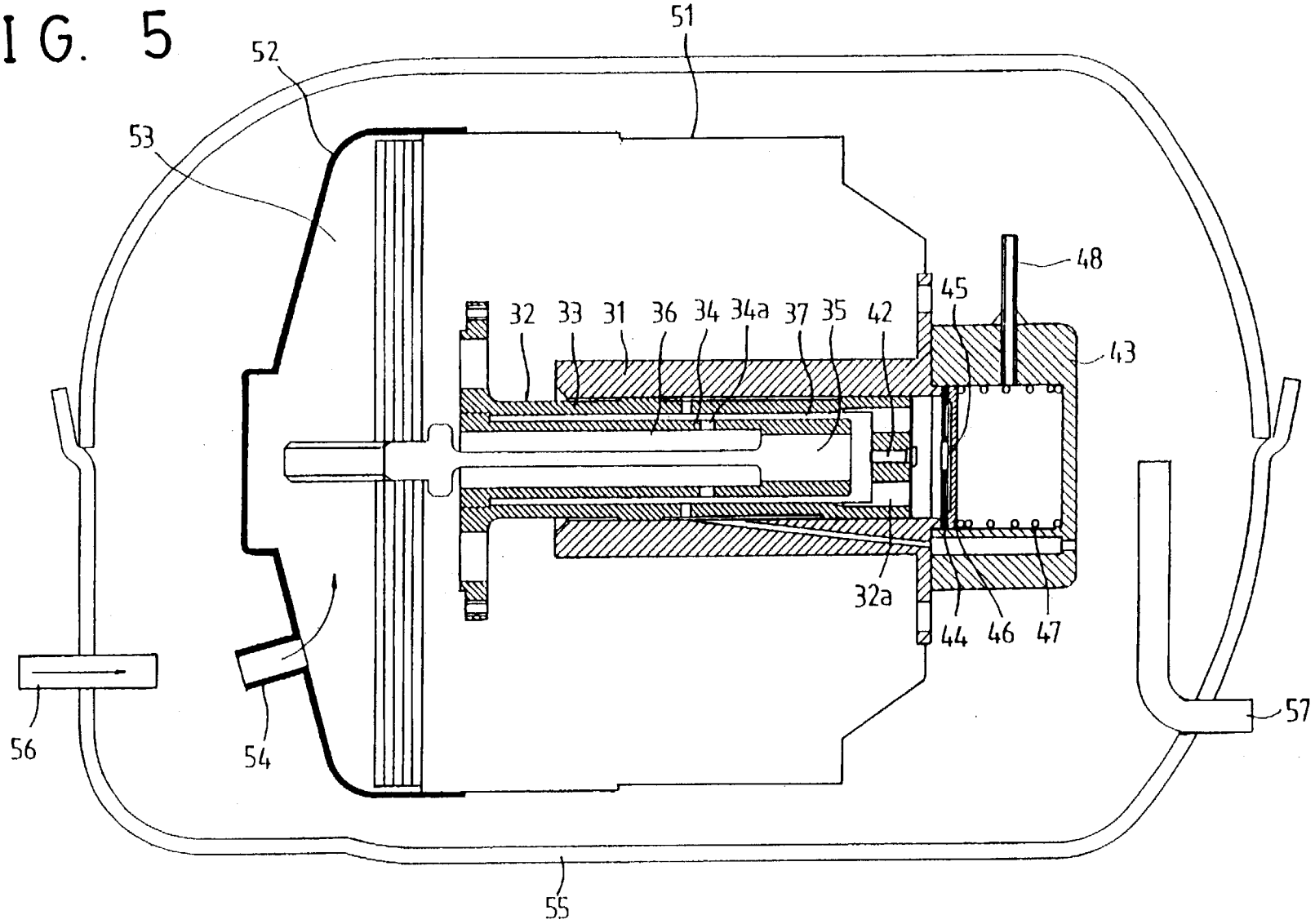
FIG. 5 is a cross-sectional view of a linear compressor in which a noise-reducing apparatus is provided according to another embodiment of the present invention.

As shown in FIG. 5, in a noise-reducing apparatus for a linear compressor according to another embodiment of the present invention, in addition to the construction of the first embodiment of the present invention, an enclosed spring holder 51 is located between an enclosed container 55 and the cylinder 31, and is integral with the cylinder 31 having a predetermined distance from the cylinder 31.

A cap 52 is fixedly connected to the end of the enclosed spring holder disclosed in the direction in which the refrigerant is sucked. Accordingly, a third silencer 53 is formed inside the cap 52, and therefore, a greater noise-reducing effect can be achieved.

Here, at a portion of the cap, an inner refrigerant suction pipe 54 is provided for sucking the refrigerant therethrough.

Reference numeral 56 denotes an outer refrigerant suction pipe, reference numeral 57 denotes a refrigerant discharging pipe, and other reference numerals denotes the same elements as those of the first embodiment of the present invention.

When the linear compressor according to the second embodiment begins to be operated, refrigerant is sucked through the outer refrigerant suction pipe 54 of the enclosed container 55, and the sucked refrigerant flows into the third silencer 53 through the inner refrigerant suction pipe 54 formed in the cap 52, resulting in the noise reduction.

In addition, the above in-flowing refrigerant enhances the effect of noise reduction, reduced through the continuously reduced through the first silencer 36 and the second silencer 37 of the cylinder 31, as shown in FIG. 5.

Therefore, in the linear compressor according to the second embodiment of the present invention, the function for reducing only the noise of the suction side and the discharging side of the conventional reciprocal movement compressor or linear compressor is improved, and thereby all the noise originating from the noise source (noise from the suction and discharging side, even from motor) inside the cap 52 can be advantageously reduced.

As described in detail above, according to the noise-reducing apparatus for a linear compressor according to the present invention, a plurality of silencers connected to the suction side of the refrigerant passage are provided inside a piston which is slidably disposed inside the cylinder and outside the cylinder, resulting in providing the remarkable noise-reduction.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed:

1. A noise-reducing apparatus for a linear compressor for reducing noise in which a plurality of silencers are formed connected to a suction side of a refrigerant passage inside a piston slidably disposed inside a cylinder, wherein the piston is formed with an outer piston disposed in the cylinder, a rod post disposed inside the outer piston and a piston rod disposed inside the rod post;

a first silencer connected to an entrance of a refrigerant passage formed between the piston rod and the rod post; and a second silencer formed between the rod post and the outer piston.

2. The noise-reducing apparatus of claim 1, wherein the first silencer and the second silencer are communicated by a passage provided at a portion of the rod post.

3. The noise-reducing apparatus of claim 1, wherein a third silencer is formed outside the cylinder to enhance the noise reduction effect.

4. The noise-reducing apparatus of claim 3, wherein at a portion of an outer circumferential surface of the cylinder is disposed one side of an enclosed spring holder, and with another side of the enclosed spring holder is coupled a cap inside which the third silencer is formed.

5. The noise-reducing apparatus of claim 4, wherein an inner refrigerant suction pipe is formed at a portion of the cap.

6. A noise-reducing apparatus for a linear compressor, comprising:

a plurality of silencers connected to a suction side of a refrigerant passage inside a piston slidably disposed inside a cylinder, wherein the piston is formed with an outer piston disposed in the cylinder, a rod post disposed inside the outer piston and a piston rod disposed inside the rod post;

and wherein the plurality of silencers comprises, a first silencer connected to an entrance of a refrigerant passage formed between the piston rod and the rod post; and a second silencer formed between the rod post and the outer piston.

7. The noise-reducing apparatus of claim 6, wherein the first silencer and the second silencer communicate via by a passage provided at a portion of the rod post.

8. The noise-reducing apparatus of claim 6, wherein a third silencer is formed outside the cylinder to enhance the noise reduction effect.

9. The noise-reducing apparatus of claim 8, wherein at a portion of an outer circumferential surface of the cylinder is disposed one side of an enclosed spring holder, and with another side of the enclosed spring holder is coupled a cap inside which the third silencer is formed.

10. The noise-reducing apparatus of claim 9, wherein an inner refrigerant suction pipe is formed at a portion of the cap.

11. The noise-reducing apparatus of claim 6, wherein the first silencer and the second silencer are mutually connected via a passage, and wherein the first silencer has a cross-section which is larger than a cross-section of the second silencer.

* * * * *